US006001226A

United States Patent [19]

Freire et al.

[11] Patent Number: 6,001,226

[45] Date of Patent: Dec. 14, 1999

[54] ELECTROCHEMICAL CELL HAVING SPLIT FLUID AND CURRENT FEED

[75] Inventors: Francisco Jose Freire; Dennie Turin Mah, both of Wilmington, Del.

[73] Assignee: E. I. du Pont de Nemours and Company, Wilmington, Del.

[21] Appl. No.: 08/883,933

[22] Filed: Jun. 27, 1997

Related U.S. Application Data

[60] Provisional application No. 06/022,505, Jun. 28, 1996.

[51] Int. Cl.[6] ..... C25B 9/00; C25B 15/08

[52] U.S. Cl. ..... 204/255; 204/268; 204/256

[58] Field of Search ..... 204/268, 255, 204/256, 269, 270

[56] References Cited

U.S. PATENT DOCUMENTS

| | | | |
|---|---|---|---|
| 1,983,296 | 12/1934 | Lacher et al. | 204/237 |
| 3,324,023 | 6/1967 | Kircher | 204/268 X |
| 4,299,681 | 11/1981 | Mose et al. | 204/255 |
| 4,312,735 | 1/1982 | Grimes et al. | 204/268 X |
| 4,336,122 | 6/1982 | Spirig | 204/222 |
| 4,339,324 | 7/1982 | Haas | 204/270 |
| 4,389,289 | 6/1983 | deNora | 205/511 |
| 4,500,403 | 2/1985 | King | 204/255 |
| 4,585,539 | 4/1986 | Edson | 204/228 |
| 5,322,604 | 6/1994 | Cawlfield | 204/257 |
| 5,411,641 | 5/1995 | Trainham, III et al. | 205/618 |

FOREIGN PATENT DOCUMENTS

| | | |
|---|---|---|
| 334613 | 1/1959 | Germany . |
| WO 93/25730 | 12/1993 | WIPO . |
| WO 95/14797 | 6/1995 | WIPO . |

*Primary Examiner*—Donald R. Valentine

[57] ABSTRACT

The present invention relates to an electrochemical cell having split fluid and current feed. Specifically, the cathode or anode inlet and outlet fluid may be fed from both, rather than from just one end of the electrolyzer. Alternatively, or additionally, the current may be fed to the anode or cathode side of the cell at one point, but may be removed from the opposite end of cell at two points. By feeding the fluid from both ends of the electrolyzer, the internal shunt current within each manifold is reduced, while the active area in the electrolyzer is increased without increasing the overall area of the current distributors. By removing the current from the electrolyzer at two points rather than just one, the voltage required by the electrolyzer may be reduced by half than if the current were removed at just one point.

10 Claims, 3 Drawing Sheets

FIG.5
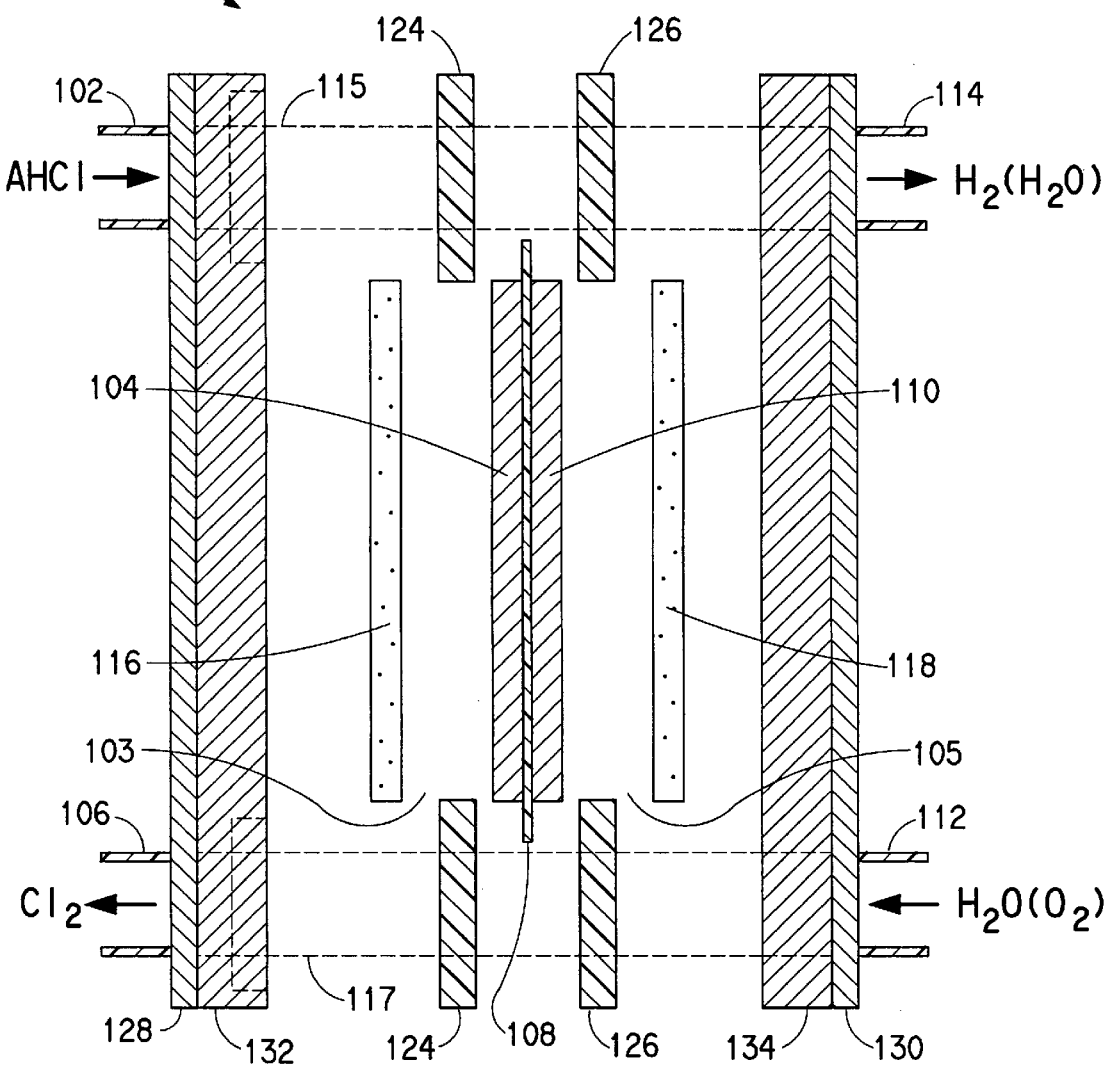
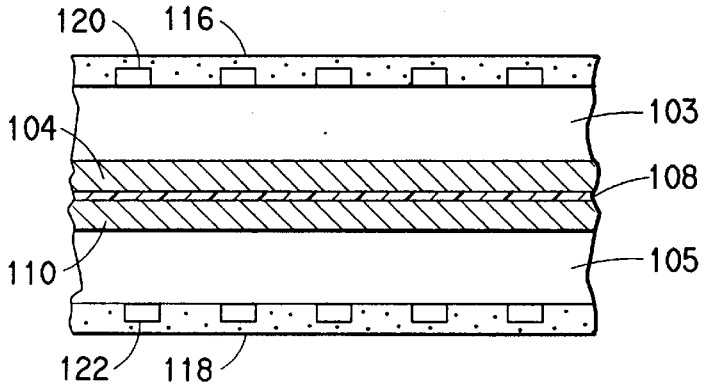
FIG.5A

ELECTROCHEMICAL CELL HAVING SPLIT FLUID AND CURRENT FEED

This application claims the priority benefit of U.S. Provisional Application No. 06/022,505, filed Jun. 28, 1996.

BACKGROUND OF THE INVENTION

1. Field of the Invention

The present invention relates to an electrochemical cell and a process having a split fluid and current feed.

2. Description of the Related Art

In the design of an internal distribution manifold electrolyzer, the cross-sectional area of the internal manifolds is calculated to maintain a minimum fluid velocity to insure minimum pressure drop from point of entry to the last cell in the electrolyzer. As the number of cells per electrolyzer increases, the cross-sectional area increases to account for the increased flow and the increased length of the manifold. This situation worsens when one of the fluids becomes a two-phase flow in the catholyte exit. In a two-phase flow system, as the pressure in the manifold decreases, the total volumetric flow increases due to gas expansion.

A typical internal manifold electrolyzer of the prior art is shown generally at 10 in FIG. 1A. FIG. 1A is a cut-away, cross-sectional view of FIG. 1, which is a front end view of a multi-cell, bi-polar electrolyzer of the prior art. Each electrochemical cell is shown at 1 in FIG. 1A. The electrolyzer shown in FIG. 1 includes a current bus 28, in which are formed anode-side inlet manifold 3, anode-side outlet manifold 7, cathode side inlet manifold 11 and cathode-side outlet manifold 15. Inlet fluid is supplied to electrolyzer 10 from one side only, such as at inlet 13 in FIG. 1A, and a blind flange 19 is typically installed at the opposite end of the manifold. Fluid flows from each electrochemical cell and into outlet manifold 15 and exits the electrolyzer at one end only, as at outlet 23 as shown in FIG. 1A. The other end of the outlet manifold is closed off with a blind flange 25.

The electrolyzer design of FIGS. 1 and 1A requires that the inlet and outlet manifolds be of large cross-sectional area to reduce fluid pressure drop. This requirement is to ensure equal fluid distribution to and from each electrochemical cell. Failure to maintain almost equal pressures throughout the manifold results in unequal flow to and from all of the cells. Such unequal flow distribution to and from each cell results in uneven performance of the cells.

Since the electrolyzer shown in FIGS. 1 and 1A requires four independent manifolds (an inlet and an outlet manifold for the anolyte and the catholyte, respectively), these manifolds consume a large fraction of the area of each current distributor plate, thus decreasing the electrolyzer active area. Such an internal manifold electrolyzer uses only 65% to 70% of its total area as active area, the balance being used to accommodate the manifolds. In addition, as the cross-sectional area of the manifolds increases, the potential for internal shunt current within each manifold also increases.

Thus, there exists a need for reducing the internal shunt current within each manifold while reducing the cross-sectional area required of the internal manifolds of an internal distribution electrolyzer, thereby increasing the active area in the electrolyzer without increasing the overall area of the current distributors.

FIG. 2 is a plan view showing the current feed to multi-cell, bi-polar electrolyzer 10 of the prior art, In the electrolyzer of the prior art of FIG. 2, current is fed to the anode-side of the electrolyzer through an electrical connection 29 and through anode-side current bus 28. Current is removed from the cell through cathode-side current bus 30 and through an electrical connection 31. In a multi-cell, bi-polar electrolyzer, the overall voltage of the electrolyzer is the product of the voltage of each individual cell and the number of cells. Thus, as it becomes necessary to add individual cells in the electrolyzer, the overall voltage of the electrolyzer increases. The higher the overall voltage of the electrolyzer gets, the greater the propensity for internal shunt currents to occur.

SUMMARY OF THE INVENTION

The present invention solves the problems of the prior art by providing an electrolyzer in which fluid is fed from both ends of the electrolyzer, thereby reducing the occurrence of internal shunt currents within each manifold and reducing the pressure drop required to ensure equal and proper fluid distribution to each cell of the electrolyzer.

The present invention also provides an electrolyzer in which one of the electrical connections is located at the mid-point of the electrolyzer and the other electrical connection is located at both ends of the electrolyzer. This allows the current to be split as it travels from the mid-point towards both ends of the electrolyzer. With this arrangement, the overall voltage of the electrolyzer is cut in half. The voltage of the electrolyzer is thus significantly reduced when compared to the voltage drop experienced by electrolyzers with known current feeds.

BRIEF DESCRIPTION OF THE DRAWINGS

FIG. 5 is a schematic diagram showing the details of an electrochemical cell for producing chlorine gas from anhydrous hydrogen chloride.

FIG. 5A is a cut-away, top cross-sectional view of the anode and cathode mass flow fields as shown in FIG. 5.

DESCRIPTION OF THE PREFERRED EMBODIMENTS

Figure 1A:
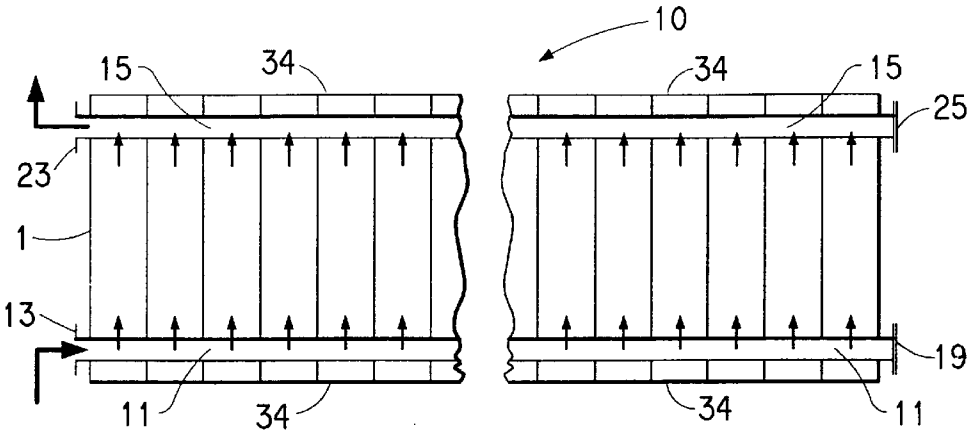
FIG. 1A (PRIOR ART)
FIG. 1A is a cut-away, cross-sectional view, taken along lines 1A—1A, of the electrolyzer of FIG. 1.
Figure 1:
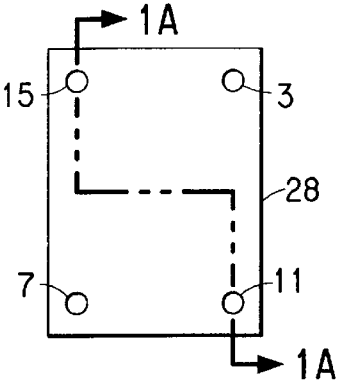
FIG. 1 (PRIOR ART)
FIG. 1 is a front-end view of an electrolyzer of the prior art, in which fluid is fed to the manifolds from one side only.
Figure 2:
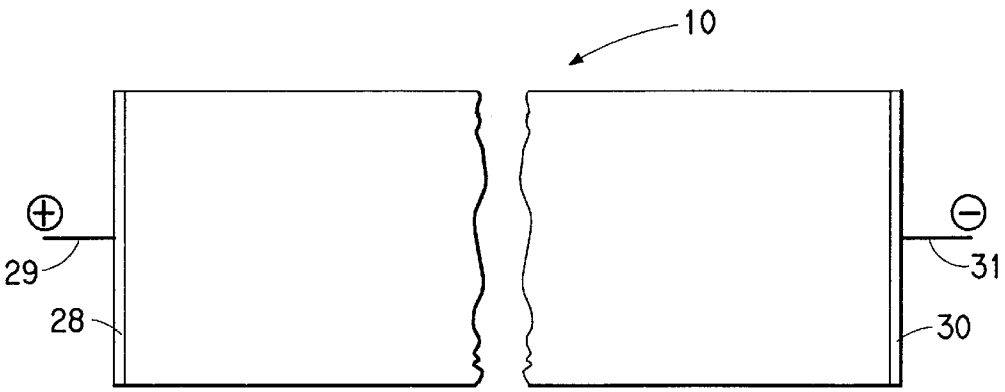
FIG. 2 (PRIOR ART)
FIG. 2 is a plan view of an electrolyzer of the prior art.

Reference will now be made in detail to the present preferred embodiments of the invention as illustrated in the accompanying drawings.

In accordance with the present invention, there is provided an electrolyzer. Such an electrolyzer is shown at 100 in FIGS. 3 and 4. The electrolyzer of the present invention includes a plurality of bi-polar electrochemical cells as shown at 101 in FIG. 3A. It should be understood that the electrolyzer of the present invention may be used for any purpose in conjunction with any multi-cell, bi-polar, internal or external distribution manifold electrolyzer, such as a chlor-alkali cell or a cell for converting aqueous hydrogen chloride to chlorine. For sake of convenience, the electrolyzer of the present invention will be described with respect to a particular embodiment, where dry chlorine gas is directly produced from anhydrous hydrogen chloride, it being understood that the cell may in addition be used to directly convert any anhydrous hydrogen halide to dry halogen gas. The term "indirect" means that the electrochemical cell of the present invention obviates the need to convert essentially anhydrous hydrogen halide to aqueous hydrogen halide before electrochemical treatment or the need to remove water from the halogen gas produced. In a first embodiment of the present invention, a halogen gas, such as chlorine gas, as well as hydrogen, may be produced in the cell of the present invention. In a second embodiment, water, as well as a halogen gas, such as chlorine gas, may be produced in this cell, as will be explained more fully below.

The electrochemical cell of the present invention comprises inlet means for supplying anhydrous hydrogen halide to the cell. The inlet means comprises an anode-side inlet 14 as shown in FIG. 5 which supplies hydrogen halide in vapor or molecular form to the cell.

The electrochemical cell of the present invention comprises means for oxidizing the hydrogen halide to produce protons and dry halogen gas. More particularly, the oxidizing means oxidizes anhydrous hydrogen chloride, (i.e., in vapor or molecular form). The oxidizing means comprises an electrode, or more specifically, an anode 12 as shown in FIG. 5.

The electrochemical cell of the present invention also outlet means for releasing the dry halogen gas. The outlet means comprises an anode-side outlet 106 as shown in FIG. 5. A portion of the anhydrous hydrogen halide, such as hydrogen chloride, may be unreacted, and this unreacted portion leaves the electrochemical cell through the anode-side outlet, along with the dry halogen gas.

The electrochemical cell of the present invention also comprises cation-transporting means for transporting the protons therethrough, wherein the oxidizing means is disposed in contact with one side of the cation-transporting means. Preferably, the cation-transporting means is a cation-transporting membrane 108, where the anode is disposed in contact with one side of the membrane as shown in FIGS. 5 and 5A. More specifically, membrane 108 may be a proton-conducting membrane. In the present invention, the membrane acts as the electrolyte. The membrane may be a commercial cationic membrane made of a fluoro- or perfluoropolymer, preferably a copolymer of two or more fluoro or perfluoromonomers, at least one of which has pendant sulfonic acid groups. The presence of carboxylic groups is not desirable, because those groups tend to decrease the conductivity of the membrane when they are protonated. Various suitable resin materials are available commercially or can be made according to the patent literature. They include fluorinated polymers with side chains of the type $—CF_2CFRSO_3H$ and $—OCF_2CF_2CF_2SO_3H$, where R is an F, Cl, $CF_2Cl$, or a $C_1$ to $C_{10}$ perfluoroalkyl radical. The membrane resin may be, for example, a copolymer of tetrafluoroethylene with $CF_2{=}CFOCF_2CF(CF_3)OCF_2CF_2SO_3H$. Sometimes those resins may be in the form that has pendant $—SO_2F$ groups, rather than $—SO_3H$ groups. The sulfonyl fluoride groups can be hydrolyzed with potassium hydroxide to $—SO_3K$ groups, which then are exchanged with an acid to $—SO_3H$ groups. Suitable perfluorinated cationic membranes, which are made of hydrated copolymers of polytetrafluoroethylene and poly-sulfonyl fluoride vinyl ether-containing pendant sulfonic acid groups, are offered DuPont under the trademark "NAFION®" (hereinafter referred to as NAFION®). In particular, NAFION® membranes containing pendant sulfonic acid groups include NAFION® 115, NAFION® 117, NAFION® 324 and NAFION® 417. The first and second types of NAFION® are unsupported and have an equivalent weight of 1100 g., equivalent weight being defined as the amount of resin required to neutralize one liter of a 1M sodium hydroxide solution. NAFION® 324 and NAFION® 417 are both supported on a fluorocarbon fabric, the equivalent weight of NAFION® 417 also being 1100 g. NAFION® 324 has a two-layer structure, a 125 $\mu$m-thick membrane having an equivalent weight of 1100 g., and a 25 $\mu$m-thick membrane having an equivalent weight of 1500 g. NAFION® 115 in particular may be used with the electrochemical cell of the present invention.

Although the present invention describes the use of a solid polymer electrolyte membrane, it is well within the scope of the invention to use other cation-transporting membranes which are not polymeric. For example, proton-conducting ceramics such as beta-alumina may be used. Beta-alumina is a class of nonstoichiometric crystalline compounds having the general structure $Na_2O_x.Al_2O_3$, in which x ranges from 5 00 (β"-alumina) to 11 (β-alumina). This material and a number of solid electrolytes which are useful for the invention are described in the *Fuel Cell Handbook*, A. J. Appleby and F. R. Foulkes, Van Nostrand Reinhold, N.Y., 1989, pages 308–312. Additional useful solid state proton conductors, especially the cerates of strontium and barium, such as strontium ytterbiate cerate ($SrCe_{0.95}Yb_{0.05}O_{3-\alpha}$) and barium neodymiate cerate ($BaCe_{0.9}Nd_{0.01}O_{3-\alpha}$) are described in a final report, DOE/MC/24218–2957, Jewulski, Osif and Remick, prepared for the U.S. Department of Energy, Office of Fossil Energy, Morgantown Energy Technology Center by Institute of Gas Technology, Chicago, Ill., December, 1990.

The electrochemical cell of the present invention also comprises means for reducing the transported protons, where the reducing means is disposed in contact with the other side of the cation-transporting means. The reducing means comprises an electrode, or more specifically, a cathode 110, where cathode 110 is disposed in contact with the other side (as opposed to the side which is in contact with the anode) of membrane 108 as illustrated in FIGS. 5 and 5A.

The electrochemical cell of the present invention also includes a cathode chamber disposed adjacent the reducing means. A cathode chamber is shown at 105 in FIGS. 5 and 5A disposed adjacent to, meaning next to or near, the reducing means, or cathode. The electrochemical cell of the present invention also comprises cathode-side inlet means for supplying water to the membrane. The cathode-side inlet means comprises a cathode-side inlet 112 as shown in FIG. 5. The cathode-side inlet is disposed in fluid communication with the cathode chamber. The electrochemical cell of the present invention also comprises cathode-side outlet means also disposed in fluid communication with the cathode chamber. The cathode-side outlet means comprises a cathode-side outlet 114 as shown in FIG. 5. A passage 115 as shown in FIG. 5 is formed between the anode-side inlet and the cathode-side outlet, and a similar passage 117 is shown formed between the cathode-side inlet and the anode-side outlet. These passages carry the reactants into and the products out of the cell through the anode and cathode-side inlets, and the anode and cathode-side outlets, as will be further explained below.

The anode and the cathode comprise an electrochemically active material. The electrochemically active material may comprise any type of catalytic or metallic material or metallic oxide, as long as the material can support charge transfer. Preferably, the electrochemically active material may comprise a catalyst material such as platinum, ruthenium, osmium, rhenium, rhodium, iridium, palladium, gold, titanium, tin or zirconium and the oxides, alloys or mixtures thereof. Other catalyst materials suitable for use with the present invention may include, but are not limited to, transition metal macro cycles in monomeric and polymeric forms and transition metal oxides, including perovskites and pyrochores.

The anode and the cathode may be porous, gas-diffusion electrodes. Gas diffusion electrodes provide the advantage of high specific surface area, as known to one skilled in the art. A particular type of gas diffusion electrode, known as an ELAT, may be used as the anode and the cathode. An ELAT comprises a support structure, as well as the electrochemically active material. In one preferred embodiment, an ELAT comprising a support structure of carbon cloth and electrochemically active material comprising ruthenium oxide, commercially available from E-TEK, of Natick, Massachusetts, may be used. Alternatively, an ELAT may be used which comprises a catalyst material mixed with carbon and particles of polytetrafluoroethylene, or PTFE, a tetrafluoropolymer resin which is sold under the trademark "TEFLON®" (hereinafter referred to as "PTFE"), commercially available from DuPont. The catalyst material, carbon particles and PTFE are then sintered on a carbon cloth substrate, which is treated with a NAFION® solution. This ELAT is held mechanically against the membrane of the cell.

Alternative arrangements of the electrochemically active material may be used for the anode and cathode of the present invention. The electrochemically active material may be disposed adjacent, meaning at or under, the surface of the cation-transporting membrane. For instance, the electrochemically active material may be deposited into the membrane, as shown in U.S. Pat. No. 4,959,132 to Fedkiw. A thin film of the electrochemically active material may be applied directly to the membrane. Alternatively, the electrochemically active material may be hot-pressed to the membrane, as shown in A. J. Appleby and E. B. Yeager, Energy, Vol. 11, 137 (1986).

If the electrodes are hot-pressed into the membrane, they have the advantage of having good contact between the catalyst and the membrane. In a hot-pressed electrode, the electrochemically active material may comprise a catalyst material on a support material. The support material may comprise particles of carbon and particles of PTFE. The electrochemically active material may be bonded by virtue of the PTFE to a support structure of carbon cloth or paper or graphite paper and hot-pressed to the cation-transporting membrane. The hydrophobic nature of PTFE does not allow a film of water to form at the anode. A water barrier in the electrode would hamper the diffusion of HCl to the reaction sites.

The loadings of electrochemically active material may vary based on the method of application to the membrane. Hot-pressed, gas-diffusion electrodes typically have loadings of 0.10 to 0.50 mg/cm$^2$. Lower loadings are possible with other available methods of deposition, such as distributing them as thin films from inks onto the membranes, to form a catalyst-coated membrane, as described in Wilson and Gottesfeld, "High Performance Catalyzed Membranes of Ultra-low Pt Loadings for Polymer Electrolyte Fuel Cells", Los Alamos National Laboratory, J. Electrochem. Soc., Vol. 139, No. 2 L28–30, 1992, where the inks contain solubilized NAFION® to enhance the catalyst-ionomer surface contact and to act as a binder to the NAFION® perfluorinated membrane sheet. With such a system, loadings as low as 0.017 mg active material per cm$^2$ have been achieved.

In one embodiment, a thin film of the electrochemically active material is be applied directly to the membrane to form a catalyst-coated membrane. In this preferred embodiment, the membrane is typically formed from a polymer as described above in its sulfonyl fluoride form, since it is thermoplastic in this form, and conventional techniques for making films from thermoplastic polymer can be used. The electrochemically active material is conventionally incorporated in a coating formulation, or "ink", which is applied to the membrane. The coating formulation, and consequently the anode and the cathode after the catalyst coated membrane is formed, also comprises a binder polymer for binding the particles of the electrochemically active material together. When the binder polymer is in the sulfonyl fluoride form, the solvent can be a variety of solvents, such as FLUORINERT FC-40, commercially available from 3M of St. Paul, Minn., which is a mixture of perfluoro(methyl-di-n-butyl)amine and perfluoro(tri-n-butylamine). In this embodiment, a copolymer polymerized from tetrafluoroethylene and a vinyl ether which is represented by the formula $CF_2{=}CF{-}O{-}CF_2CF(CF_3){-}O{-}CF_2CF_2SO_2F$ has been found to be a suitable binder polymer. In addition, ruthenium dioxide has been found to be a suitable catalyst. The sulfonyl fluoride form has been found to be compatible with FC-40 and to give a uniform coating of the ruthenium dioxide catalyst on the membrane.

If a catalyst-coated membrane as described above is used, the electrochemical cell must include a gas diffusion layer (not shown) disposed in contact with the anode and the cathode, respectively, (or at least in contact with the anode), on the side of the anode or cathode opposite the side which is in contact with the membrane. The gas diffusion layer provides a porous structure that allows the anhydrous hydrogen chloride to diffuse through to the layer of electrochemically active material of the catalyst-coated membrane. In addition, both the anode gas diffusion layer and the cathode gas diffusion layer distribute current over the electrochemically active material, or area, of the catalyst-coated membrane. The diffusion layers are preferably made of graphite paper, and are typically 15–20 mil thick.

When using any type of membrane and electrodes with the present invention, the membrane must be kept hydrated in order to increase the efficiency of proton transport through the membrane. This keeps the conductivity of the membrane high. In the present invention, the hydration of the membrane is accomplished by keeping liquid water in contact with the cathode-side of the membrane. This can be done by either adding liquid water to the cathode-side of the membrane in the first embodiment, or adding an oxygen-containing gas to the cathode-side of the membrane. To illustrate this point with respect to the first embodiment, water is added to the electrochemical cell through cathode-side inlet 112. The protons which are produced by the oxidation of the hydrogen halide are transported through the membrane and reduced at the cathode to form hydrogen gas. This hydrogen gas is evolved at the interface between the cathode and the membrane. The hydrogen gas, which is shown as $H_2$ in FIG. 5, exits the cell through the cathode-side outlet. In addition, a portion of the water supplied to the cathode-side inlet is released through the cathode-side outlet, as shown as $H_2O$ in FIG. 5.

Returning again to the description of FIG. 5, the electrochemical cell of the present invention further comprises an anode flow field 116 disposed in contact with the anode and a cathode flow field 118 disposed in contact with the cathode as shown in FIGS. 5 and 5A. The flow fields are electrically conductive, and act as both mass and current flow fields.

Preferably, the anode and the cathode flow fields comprise porous graphite paper. Such flow fields are commercially available from Spectracorp, of Lawrence, Mass. However, the flow fields may be made of any material and in any manner known to one skilled in the art. For example, the flow fields may alternatively be made of a porous carbon in the form of a foam, cloth or matte. For the purpose of acting as mass flow fields, the anode mass flow field includes a plurality of anode flow channels 120, and the cathode mass flow field includes a plurality of cathode flow channels 122 as shown in FIG. 5A, which is a cut-away, top cross-sectional view showing only the flow fields of FIG. 5. Preferably, the channels of the anode mass flow field and the channels of the cathode mass flow field are parallel to each other, and more particularly, are vertical and parallel to each other. The anode flow fields and the anode flow channels get reactants, such as hydrogen chloride, to the anode and products, such as dry chlorine gas, as well as any unreacted hydrogen chloride, from the anode. The cathode flow field and the cathode flow channels get catholyte, such as liquid water to the membrane and products, such as hydrogen gas and water, from the cathode.

The electrochemical cell of the present invention may also comprise an anode-side gasket 124 and a cathode-side gasket 126 as shown in FIG. 5. Gaskets 124 and 126 form a seal between the interior and the exterior of the electrochemical cell. Preferably, the anode-side gas is made of a fluoroelastomer, sold under the trademark VITON® (hereinafter referred to as VITON®) by DuPont Dow Elastomers L. L. C. of Wilmington, Del. The cathode-side gasket may be made of the terpolymer ethylene/propylene/diene (EPDM), sold under the trademark NORDEL® by DuPont, or it may be made of VITON®.

The electrochemical cell of the present invention also comprises an anode current bus 128 and a cathode current bus 130 as shown in FIG. 5. Anode current bus 128 is also shown in FIGS. 3 and 4, and cathode current bus 130 is also shown in FIG. 4. The current buses conduct current to and from a voltage source (not shown). Specifically, anode current bus 128 is connected to the positive terminal of a voltage source, and cathode current bus 130 is connected to the negative terminal of the voltage source, so that when voltage is applied to the cell, current flows through all of the cell components to the right of current bus 128 as shown in FIG. 5, including current bus 130, from which it returns to the voltage source. The current buses are made of a conductor material, such as copper.

The electrochemical cell of the present invention may further comprise an anode current distributor 132 as shown in FIG. 5. The anode current distributor collects current from the anode current bus and distributes it to the anode by electronic conduction. The anode current distributor may comprise a fluoropolymer which has been loaded with a conductive material. In one embodiment, the anode current distributor may be made from polyvinylidene fluoride, sold under the trademark KYNAR® (hereinafter referred to as "KYNAR®") by Elf Atochem North America, Inc. Fluoropolymers, and graphite.

The electrochemical cell of the present invention may further comprise a cathode current distributor 134 as shown in FIG. 5. The cathode current distributor collects current from the cathode and for distributing current to the cathode bus by electronic conduction. The cathode distributor also provides a barrier between the cathode current bus and the cathode and the hydrogen halide. Like the anode current distributor, the cathode current distributor may comprise a fluoropolymer, such as KYNAR®, which has been loaded with a conductive material, such as graphite.

The electrochemical cell of the present invention also includes an anode-side steel backer plate (not shown), disposed on the outside of the cell next to the anode current distributor, and a cathode-side steel backer plate (also not shown), disposed on the outside of the cell next to the cathode current distributor. These steel backer plates have bolts extending therethrough to hold the components of the electrochemical cell together and add mechanical stability thereto.

In the bipolar electrolyzer as shown in FIG. 4, electrochemical cells, such as cell 101 as shown in FIG. 5, including anode current distributor 132 and every element to the right of the anode current distributor as shown in FIG. 5, up to and including cathode current distributor, are repeated along the length of the electrolyzer. In the electrolyzer of the present invention as illustrated in FIG. 4, one current bus is placed in the middle of the stack and the other current buses are placed on the outside of the stack, as will be explained below.

Figure 3A:
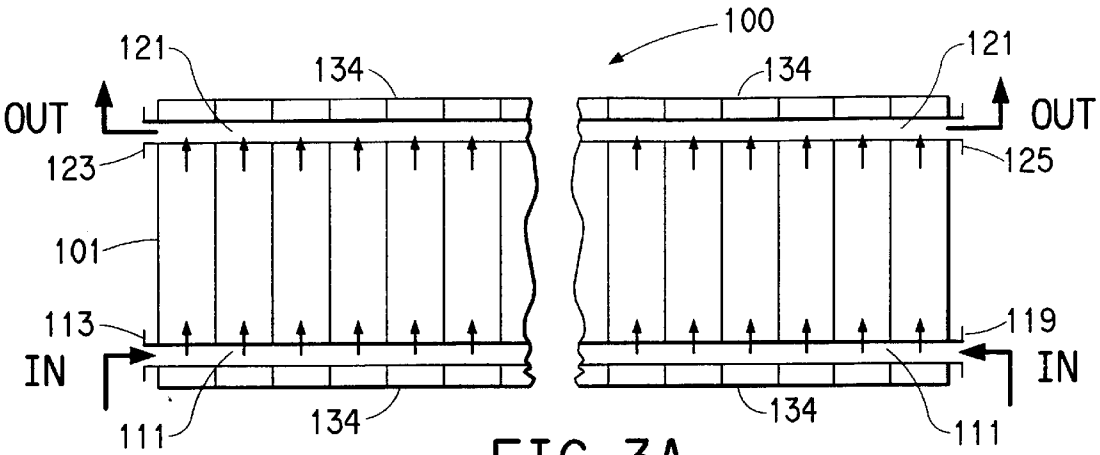
FIG. 3A is a cut-away, cross-sectional view, taken along lines 3A—3A, of the electrolyzer of FIG. 3.
Figure 3:
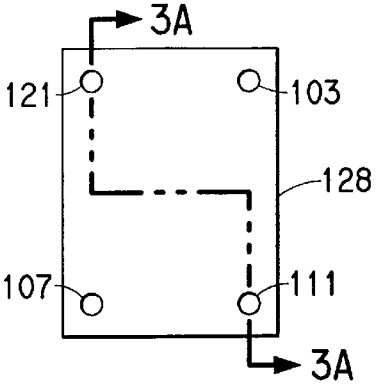
FIG. 3 is a front-end view of an electrolyzer of the present invention, in which fluid is fed to the manifolds from both ends of the electrolyzer.
Figure 4:
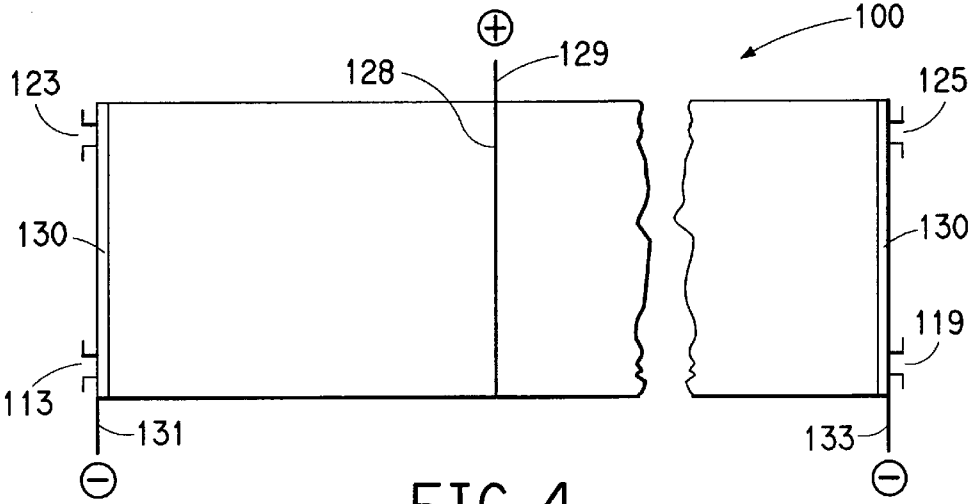
FIG. 4 is an elevational view of an electrolyzer of the present invention.

Returning to the description of the electrolyzer of FIGS. 3 and 3A, the electrolyzer of the present invention includes an inlet manifold disposed in fluid communication with each electrochemical cell. Such an inlet manifold is shown at 111 in FIG. 3A. Inlet manifold 111 communicates with cathode-side inlet 112 of each cell, which cell inlet is described above. A first inlet 113 is disposed at one end of the inlet manifold for supplying a first portion of the electrochemical cells with an inlet fluid, which in the illustrated embodiment, is water. In the illustrated embodiment of FIG. 5, the possibility that shunt currents could occur on the cathode-side arises, since the catholyte, at least in the first embodiment, is water. Thus, the electrolyzer of the present invention is illustrated in FIGS. 3 and 3A for the case where the cathode-side inlet and outlet feed is split, it being understood that the anode inlet and outlet feed of the electrolyzer of the present invention may alternatively or additionally be split, depending on the characteristics of the fluid flowing therethrough. In the illustrated electrolyzer in FIG. 3A, the first portion is the portion to the left of the cut-away, it being understood that the first portion may be any multiple number of cells. The inlet manifold also includes a second inlet disposed at the other end of the inlet manifold for supplying a second portion of the electrochemical cells with the inlet fluid. Such an inlet is shown at 119 in FIG. 3A. In the electrolyzer of FIG. 3A, the second portion is the portion to the right of the cut-away, it again being understood that the second portion may be any multiple number of cells.

The electrolyzer of the present invention further includes an outlet manifold disposed in fluid communication with each electrochemical cell. A first outlet manifold is shown at 121 in FIGS. 3 and 3A. A first outlet is disposed at one end of the outlet manifold for receiving an outlet fluid from the first portion of the electrochemical cells. Outlet manifold 121 is disposed in fluid communication with the cathode-side outlet, such as 114 as shown in FIG. 5, of all the electrochemical cells. A first outlet is shown at 123 in FIG. 3A, and it receives an outlet fluid, such as hydrogen gas, as described above with respect to the first embodiment, from the first portion of the electrochemical cells. The electrolyzer of the present invention also includes a second outlet disposed at the other end of the outlet manifold for receiving the fluid from the second portion of the electrochemical cells. A second outlet is shown at 125 in FIG. 3A and receives the outlet fluid from the second portion of the electrochemical cells. Since the fluid will take the path of least resistance, the first portion of the electrochemical cells which release the outlet fluid coincides with the first portion of the electrochemical cells into which inlet fluid flows, as described above. For example, if fluid flows into six cells from the inlet manifold, it will flow out of the same six cells to the outlet manifold.

The same arrangement can be used for the other side of the electrolyzer. For example, the anode inlet and outlet fluid feed may be alternatively or additionally split. Hence, the electrolyzer of the present invention may also include another inlet manifold which is disposed in fluid communication with each of the electrochemical cells. The end of such an inlet manifold is shown at 103 in FIG. 3. The inlet manifold may include a third inlet, not shown, disposed at one end of this other inlet manifold for supplying the first portion of the electrochemical cells with another inlet fluid, and another inlet, also not shown, disposed at the other end of the second inlet manifold for supplying the second portion of the electrochemical cells with this inlet fluid.

It should be noted that instead of the arrangement shown in FIG. 3A, where fluid is fed from both ends of the electrolyzer, and exits from both ends of the electrolyzer, it is also within the scope of the present invention to have a feed block positioned in the middle of the electrolyzer as shown in FIG. 3A. Such feed block would feed inlet fluid to the middle of the electrolyzer, and the fluid would exit through both ends of the electrolyzer, such as through outlets 123 and 125 as shown in FIG. 3A. Alternatively, it is also possible to have fluid supplied to the electrolyzer from both ends, such as through inlets 113 and 119 as shown in FIG. 3A, but for the fluid to exit the electrolyzer through one outlet block, instead of through the two outlets 123 and 125 shown in FIG. 3A.

The electrolyzer of the present invention may also include another outlet manifold disposed in fluid communication with each electrochemical cell. The second outlet manifold may include a third outlet disposed at one end of the this other outlet manifold for receiving an outlet fluid from the first portion of the electrochemical cells, and an outlet disposed at the other end of this other outlet manifold for receiving the outlet fluid from the second portion of the electrochemical cells.

The present invention also provides for split current feed to an electrolyzer. FIG. 4 shows a split current feed arrangement which is used with the split fluid feed arrangement as described above. However, it should be understood that the split current feed of the present invention may be used independently of the split fluid feed. The electrolyzer of the present invention may include a first connection for supplying a current at a given voltage to all electrochemical cells of the electrolyzer. In the electrolyzer of FIG. 4, a first electrical connection 129 supplies a current at a positive voltage to the electrolyzer through anode-side current bus 128. Also, a second electrical connection removes current from a first portion of the electrochemical cells at a lower voltage than the given voltage. A second electrical connection is shown at 131 in FIG. 4. A third electrical connection removes current from a second portion of the electrochemical cells at the lower voltage, meaning the same voltage as the second connection. Connections 131 and 133 remove the current from the cells from cathode-side current buses 130. By removing the current at two points instead of one, the voltage drop per section of the electrolyzer, and hence the voltage of the electrolyzer, is cut in half. It should be noted that although the current is split at the cathode-side of the electrolyzer in FIG. 4, it is alternatively within the scope of the present invention to split the current at the anode-side of the electrolyzer. It should also be noted that instead of supplying the current at one point and removing the current from two points, it is within the scope of the present invention to supply the current at two points (i.e., there would be two positive connections 128 in FIG. 4) and remove the current at one point (i.e., there would be one negative connection, either 131 or 133 in FIG. 4). This may be done on the anode or the cathode side.

The operation of the electrolyzer will be described with respect to the situation where the electrolyzer includes both split current and fluid feed, it being understood that either may be used independently of the other. In addition, the operation will be described with respect to the conversion of anhydrous hydrogen chloride to dry chlorine gas, but it should be understood that the split fluid and current feed of the present invention may be employed for an electrolyzer which electrolyzes any type of fluid where shunt currents are a problem. In operation, a voltage is applied to the anode and the cathode so that the anode is at a higher potential than the cathode, and current flows to the anode bus through connection 129. Anode current distributor 132 collects current from the anode bus and distributes it to the anode by electronic conduction. Anhydrous hydrogen chloride is supplied to anode-side inlet 102 and through flow channels 120 in the anode mass flow field 116. The hydrogen chloride is transported to the surface of anode 104. Hydrogen chloride is oxidized at the anode under the potential created by the voltage source to produce protons ($H^+$) and dry chlorine gas. The dry chlorine gas produced at the anode is released from anode-side outlet 106 of the electrochemical cell as shown in FIG. 5. A portion of the hydrogen chloride may be unreacted in the cell. In this case, the unreacted hydrogen chloride is released from the anode-side outlet, along with the dry chlorine gas.

The protons are transported through the membrane, which acts as an electrolyte. The transported protons are reduced at the cathode. Water is delivered to the cathode through first and second inlets of the inlet manifold, such as inlets 113 and 119 of inlet manifold 111 as shown in FIG. 3A, to a cathode-side inlet of each cell, such as cathode-side inlet 112 as shown in FIG. 5, and through the channels in the cathode mass flow field, such as channels 122 in cathode mass flow field 118 to hydrate the membrane and thereby increase the efficiency of proton transport through the membrane. In the present invention, the hydrogen which is evolved at the interface between the cathode and the membrane exits via cathode-side outlet 114, along with a portion of the water which is delivered to the cathode-side inlet. The hydrogen from a first portion of the electrochemical cells travels through an outlet manifold, such as manifold 121, to an outlet, such as outlet 123, and the hydrogen from a second portion of the electrochemical cells travels through the outlet manifold, such as manifold 121, to an outlet, such as outlet 125. Cathode current distributor 134 collects current from cathode 110, and distributes it to cathode bus 130. The current is removed from a first portion of the electrochemical cells through a split current connection, such as connection 131 and from a second portion of the electrochemical cells through a split current connection, such as connection 133.

Additional advantages and modifications will readily occur to those skilled in the art. The invention, in its broader aspects, is therefore not limited to the specific details and representative apparatus shown and described. Accordingly, departures may be made from such details without departing from the spirit or scope of the general inventive concept as defined by the appended claims and their equivalents.

What is claimed is:

1. An electrolyzer, comprising:

(a) a plurality of bi-polar electrochemical cells;

(b) an inlet manifold disposed in fluid communication with each electrochemical cell;

(c) a first inlet disposed at one end of the inlet manifold for supplying a first portion of the electrochemical cells with an inlet fluid, said first portion being a multiple number of cells; and (d) a second inlet disposed at the other end of the inlet manifold for supplying a second portion of the electrochemical cells with the inlet fluid, said second portion being a multiple number of cells.

2. The electrolyzer of claim 1, further including:

(e) an outlet manifold disposed in fluid communication with each electrochemical cell;

(f) a first outlet disposed at one end of the outlet manifold for receiving an outlet fluid from the first portion of the electrochemical cells, said first portion being a multiple number of cells; and (g) a second outlet disposed at the other end of the outlet manifold for receiving the outlet fluid from the second portion of the electrochemical cells, said second portion being a multiple number of cells.

3. An electrolyzer, comprising:

(a) a plurality of bi-polar electrochemical cells;

(b) an inlet manifold disposed in fluid communication with each electrochemical cell;

(c) a first inlet disposed at one end of the inlet manifold for supplying a first portion of the electrochemical cells with an inlet fluid;

(d) a second inlet disposed at the other end of the inlet manifold for supplying a second portion of the electrochemical cells with the inlet fluid;

(e) a first connection for supplying current at a given voltage to all the electrochemical cells;

(f) a second connection for removing current at a lower voltage than the given voltage from the first portion of electrochemical cells; and (g) a third connection for removing current at a lower voltage from the second portion of electrochemical cells.

4. An electrolyzer, comprising:

(a) a plurality of bi-polar electrochemical cells;

(b) an inlet manifold disposed in fluid communication with each electrochemical cell;

(c) a first inlet disposed at one end of the inlet manifold for supplying a first portion of the electrochemical cells with an inlet fluid;

(d) a second inlet disposed at the other end of the inlet manifold for supplying a second portion of the electrochemical cells with the inlet fluid;

(e) an outlet manifold disposed in fluid communication with each electrochemical cell;

(f) a first outlet disposed at one end of the outlet manifold for receiving an outlet fluid from the first portion of the electrochemical cells;

(g) a second outlet disposed at the other end of the outlet manifold for receiving the outlet fluid from the second portion of the electrochemical cells;

(h) a first connection for supplying current at a given voltage to all the electrochemical cells;

(i) a second connection for removing current at a lower voltage than the given voltage from the first portion of electrochemical cells; and (j) a third connection for removing current at a lower voltage from the second portion of electrochemical cells.

5. An electrolyzer, comprising:

(a) a plurality of bi-polar electrochemical cells;

(b) a first connection for supplying current at a given voltage to all the electrochemical cells;

(c) a second connection for removing current at a lower voltage than the given voltage from a first portion of the electrochemical cells; and (d) a third connection for removing current at a lower voltage from a second portion of the electrochemical cells.

6. The electrolyzer of claim 5, further including:

(e) an inlet manifold disposed in fluid communication with each electrochemical cell;

(f) a first inlet disposed at one end of the inlet manifold for supplying a first portion of the electrochemical cells with an inlet fluid; and (g) a second inlet disposed at the other end of the inlet manifold for supplying a second portion of the electrochemical cells with the inlet fluid.

7. The electrolyzer of claim 6, further including an outlet manifold disposed in fluid communication with each electrochemical cell, a first outlet disposed at one end of the outlet manifold for receiving the outlet fluid from the first portion of the electrochemical cells and a second outlet disposed at the other end of the outlet manifold for receiving the outlet fluid from the second portion of the electrochemical cells.

8. An electrolyzer for the direct production of dry halogen gas fron anhydrous hydrogen halide, comprising:

(a) a plurality of bi-polar electrochemical cells, each electrochemical cell comprising:

(i) means for oxidizing hydrogen halide and for producing dry halogen gas and protons;

(ii) cation-transporting means for transporting the protons therethrough, and (iii) reducing means for reducing the protons;

(b) a cathode-side inlet manifold disposed in fluid communication with each electrochemical cell;

(c) a first cathode-side inlet disposed at one end of the cathode-side inlet manifold for supplying a first portion of the electrochemical cells with water; and (d) a second cathode-side inlet disposed at the other end of the cathode-side inlet manifold for supplying a second portion of the electrochemical cells with water.

9. The electrolyzer of claim 8, further including a cathode-side outlet manifold disposed in fluid communication with each electrochemical cell, a first cathode-side outlet disposed at one end of the cathode-side outlet manifold for receiving hydrogen gas from the first portion of the electrochemical cells and a second cathode-side outlet disposed at the other end of the cathode-side outlet manifold for receiving hydrogen gas from the second portion of the electrochemical cells.

10. The electrolyzer of claim 9, further including:

(e) a first connection for supplying current at a positive voltage to all the electrochemical cells;

(f) a second connection for removing current at a negative voltage from the first portion of electrochemical cells; and (g) a third connection for removing current at a negative voltage from the second portion of electrochemical cells.

* * * * *